United States Patent [19]

Rossmann et al.

[11] 4,440,085

[45] Apr. 3, 1984

[54] SAFETY APPARATUS FOR SPINNING PROJECTILE FUZES

[75] Inventors: Rudolf Rossmann, Zurich; Paul Cahannes, Embrach, both of Switzerland

[73] Assignee: Werkeugmaschinenfabrik Oerlikon-Bührle AG, Zurich, Switzerland

[21] Appl. No.: 386,354

[22] Filed: Jun. 8, 1982

[30] Foreign Application Priority Data

Jun. 30, 1981 [CH] Switzerland ..... 4287/81

[51] Int. Cl.[3] ..... F42C 15/26

[52] U.S. Cl. ..... 102/235; 102/240; 102/274

[58] Field of Search ..... 102/235, 245, 231, 237, 102/251, 222, 233, 240, 274

[56] References Cited

U.S. PATENT DOCUMENTS

| | | | |
|---|---|---|---|
| 2,682,835 | 7/1954 | Meister | 102/245 |
| 3,595,169 | 7/1971 | Ziemba | 102/235 |
| 3,608,494 | 9/1971 | Ziemba | 102/235 |

FOREIGN PATENT DOCUMENTS

| | | |
|---|---|---|
| 539630 | 1/1956 | Belgium . |
| 2539750 | 3/1977 | Fed. Rep. of Germany . |
| 2034677 | 12/1970 | France . |
| 107246 | 6/1917 | United Kingdom . |

*Primary Examiner*—David H. Brown

*Attorney, Agent, or Firm*—Werner W. Kleeman

[57] ABSTRACT

A spinning projectile fuze contains a rotor which is retained by a safety spring in the form of a substantially ring-shaped disk in a safety or unarmed position. To enable the ring-shaped disk to release the rotor it must be pressed flat both by the firing acceleration and also by the spin. This ring-shaped disk possesses cut-outs or recesses by means of which it is subdivided into segments which are bent in an undulated or wave-shaped configuration.

6 Claims, 3 Drawing Figures

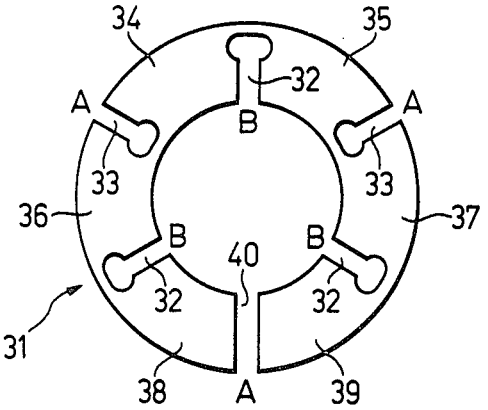
FIG. 3
FIG. 2
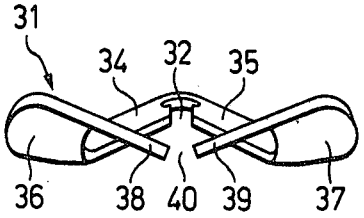
FIG. 1
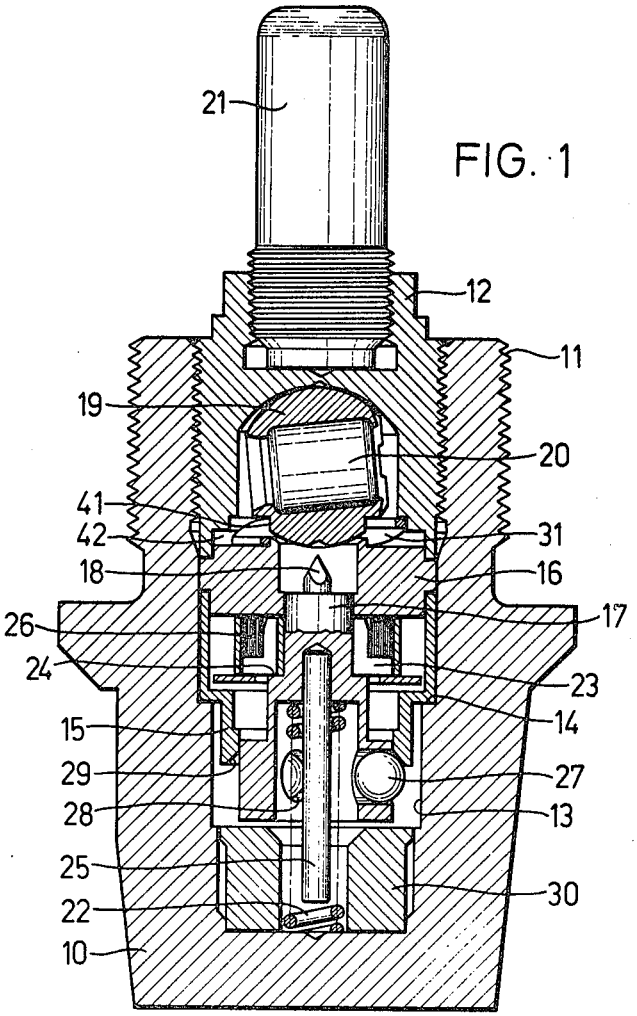

SAFETY APPARATUS FOR SPINNING PROJECTILE FUZES

BACKGROUND OF THE INVENTION

The present invention relates to a new and improved construction of a safety apparatus or delay arming device for a spinning projectile fuze.

Generally speaking, the safety apparatus for a spinning projectile fuze as contemplated by the invention is of the type comprising a ball-shaped or spherical rotor which can rotate out of a safety or unarmed position into an armed or live position. A closure body member and a support member are provided, between which there is rotatably mounted the rotor. A first ring-shaped groove is provided in the closure body member or closure body. This first ring-shaped groove is located in a plane which is disposed essentially perpendicular to the lengthwise axis of the projectile. A second ring-shaped groove is provided in the ball-shaped or spherical rotor. This second ring-shaped groove, in the safety or unarmed position of the rotor, is located in a plane which is disposed substantially perpendicular to the projectile axis. Also, there is provided a safety spring in the form of a substantially ring-shaped disk or plate member which protrudes both into the first groove and also into the second groove and serves to secure the rotor in its safety position. This safety spring can be deformed by the firing acceleration and by the spin, for the purpose of freeing the rotor so that it can move into its armed or armed position.

A state-of-the-art time-delay fuze of this general type has been disclosed in U.S. Pat. No. 3,595,169, granted July 27, 1971. Such time-delay fuze contains a ball-shaped rotor which is rotatably mounted in a hollow cavity or space of the fuze housing. The firing pin, this hollow cavity and a booster charge are located along the longitudinal axis of the fuze. The rotor contains a detonator cap within a continuous bore of the rotor, and a disk-shaped ring, which protrudes into a groove of the rotor, retains the rotor along with the detonator cap in a safety position. To release the rotor for movement into its armed position the disk-shaped ring must be pressed flat by the firing acceleration and enlarged by the spin.

However, this prior art safety ring does not ensure for any adequate safety during transport of the projectile. If vibrations occur during the transport of projectiles equipped with such fuzes, then it can happen that the rotor will rotate into its armed position.

A further known safety apparatus for spinning projectiles of the aforementioned type is disclosed in German Patent Publication No. 2,539,750, published Oct. 11, 1979. Such safety apparatus contains a horseshoe-shaped safety element which is already deformed by the projectile spin to such an extent that the rotor can rotate into its armed position. Such safety element does not comply with the security requirements which are frequently placed upon such type of safety apparatuses.

Other prior art constructions of delay arming devices or the like have been disclosed, for instance, in U.S. Pat. No. 2,682,835, granted July 6, 1954, British Pat. No. 107,246, published June 25, 1917, Belgium Pat. No. 539,630, granted Jan. 7, 1956, and French Pat. No. 2,034,677, published Nov. 11, 1970.

SUMMARY OF THE INVENTION

It is a primary object of the present invention to provide a new and improved safety apparatus for spinning projectile fuzes which is not associated with the aforementioned drawbacks and limitations of the prior art proposals.

Another and more specific object of the present invention aims at providing a new and improved construction of a safety apparatus of the character described, which reliably fulfils the security or safety requirements, i.e. the safety element first frees the rotor when there are effective two mutually independent forces, for instance the firing acceleration and the spin are effective upon the safety element.

Yet a further significant object of the present invention aims at the provision of a new and improved construction of safety apparatus for spinning projectile fuzes which affords reliable security during transport of the projectiles.

Still a further significant object of the present invention is directed to a new and improved construction of a safety apparatus for projectile fuzes, which safety apparatus is relatively simple in construction and design, extremely reliable in operation, not readily subject to breakdown or malfunction, and effectively safeguards against any undesired premature detonation of the spinning projectile fuze.

Now in order to implement these and still further objects of the invention, which will become more readily apparent as the description proceeds, the safety or security apparatus of the present devlopment is manifested by the features that, the substantially ring-shaped disk or plate member is subdivided into segments by cut-outs or recesses, and the successive segments are alternately directed in a wave-shaped or undulated configuration upwardly and downwardly.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a longitudinal sectional view through a base fuze for a spinning projectile and illustrating the parts thereof in the safety or unarmed position of the fuze;

FIG. 2 is a top plan view of the safety or security spring used in the base fuze of the arrangement of FIG. 1; and FIG. 3 is a side view of the safety spring shown in FIG. 2.

DETAILED DESCRIPTION OF THE PREFERRED EMBODIMENTS

Describing now the drawings, in FIG. 1 there is disclosed by way of example and not limitation a base fuze for a not particularly shown projectile and which contains an essentially cylindrical housing 10. This housing 10 can be threaded by means of the external threads 11 into the not here shown projectile body of a rotating or spinning projectile. Within this housing 10 there is threadably connected a bearing body 12 within a bore 13, and which bearing body 12 defines a closure or closure body member. The bore 13 contains a shoulder 14 upon which bears a guide sleeve 15. Upon this guide sleeve or sleeve member 15 there is seated a guide disk or disk member 16, defining a support member, which is pressed against the guide sleeve 15 by the action of the bearing or closure body member 12, so that the aforementioned components are securely fixed within the fuze housing 10.

A hammer sleeve or puncture body 17 is displaceably guided at its lowermost portion in the guide sleeve 15 and at its uppermost portion in the guide disk 16 which, as stated, constitutes a support. At the upper portion of the hammer sleeve 17 there is attached a firing pin 18. In the bearing or closure body member 12 there is located a substantially spherical or ball-shaped rotor 19 which contains a detonator cap or detonator 20. The ball-type rotor 19 can rotate by the action of the spin of the projectile out of the illustrated safety or unarmed position into its armed or live position. Furthermore, there is secured at the bearing or closure body or body member 12 a booster charge 21 which protrudes into the not here particularly illustrated but conventional explosive charge of the projectile body.

A self-destruction spring 22 bears at one end upon the floor of the fuze housing 10 and at the other end upon the hammer sleeve 17. This self-destruction or self-destruct spring 22 strives to displace the hammer sleeve 17 together with the firing pin 18 against the detonator cap or detonator 20. This displacement is prevented by a number of locking body members 23 which bear at one end at the guide disk 16 and at the other end at a shoulder 24 of the hammer sleeve 17. A bolt 25 is located internally of the self-destruction spring 22 and serves for guiding such spring. The segment-shaped locking body members 23 are held together by a centrifugal force band member 26 which consists of a small metallic foil and is wound about the locking body members 23. Furthermore, the displacement of the hammer sleeve or puncture body 17 is prevented by spherical or ball-shaped centrifugal body members 27 which are located in radial bores 28 of the hammer sleeve or puncture body 17 and bear, under the action of the projectile spin, upon a substantially conical surface 29 provided at the inner wall or surface of the guide sleeve 15. Behind the hammer sleeve or puncture body 17 there is arranged an inertia body 30 within the fuze housing 10.

According to the invention, there is importantly located below the rotor 19 also a safety spring or spring member 31 in the form of a substantially ring-shaped disk or plate member, by means of which the rotor 19, prior to firing of the projectile, is prevented from rotating into its armed or live position.

The form of this disk or plate member 31 will be readily apparent by referring to FIGS. 2 and 3. As best seen by inspecting such FIGS. 2 and 3, the ring-shaped disk member 31 is divided by three inner cut-outs or recesses 32 and two outer cut-outs or recesses 33 into six segments 34, 35, 36, 37, 38 and 39, and the disk member 31 is open or split at the location 40. Viewed from this split location 40 the segments 38 and 39 are upwardly directed in the showing of FIG. 2. The subsequent segments 36 and 37 are downwardly inclined, and finally, both of the last two segments 34 and 35 are again upwardly directed. By virtue of the cut-outs or recesses 32 and 33, between which there are formed webs, the safety or security spring 31 defining the disk member is weakened to such an extent that under the action of the firing acceleration the aforementioned six segments 34, 35, 36, 37, 38 and 39 can lie substantially flat in a plane, and due to the spin of the projectile the split ring-shaped disk 31 can widen or enlarge.

As best seen by reverting to FIG. 1, the spherical or ball-shaped rotor 19 possesses a substantially ring-shaped groove 41 into which protrudes the ring-shaped safety spring 31. Additionally, the closure or bearing body member 12 possesses a groove 42 which is enlarged at the lower region of this safety spring 31, so that the safety spring 31 can widen or enlarge in radial direction as soon as it has been pressed flat.

Having now had the benefit of the foregoing description of the safety apparatus for a spinning projectile fuze, there will be considered in detail the mode of operation of the described fuze which is as follows:

Upon firing of the not particularly illustrated projectile the safety spring 31 is pressed flat due to the action of the firing acceleration and bears against the guide or support disk 16. Additionally, due to the projectile spin the safety spring 31 is enlarged or widened and the rotor 19 is rotated, out of the safety position depicted in FIG. 1, into its armed or live position where the axis of the detonator cap or detonator 20 substantially coincides with the longitudinal axis of the projectile. Consequently, the firing pin 18 is capable of puncturing the detonator cap or detonator 20. Furthermore, due to the projectile spin the centrifugal force band member 26 is unwound out of the position depicted in FIG. 1 until it bears against the inner wall of the guide sleeve or sleeve member 15, with the result that the locking body members 33 can move out of their locking position into their release position. The hammer sleeve 17 is then only still retained by the centrifugal force bodies 27 which, under the action of the projectile spin, bear against the conical surface 29 of the guide sleeve 15, and thus, prevent puncturing of the detonator cap 20 by the firing pin 18.

Upon impact of the projectile the inertia body member 30 and the hammer sleeve 17 are forwardly accelerated or thrusted. The inertia body 30 thus drives the hammer sleeve 17, so that the firing pin 18 attached to the front face of the hammer sleeve or puncture body member 17 impacts against the detonator cap 20 with the required velocity.

The rotor 19 is particularly secured against unintentionally rotating into its armed or live position by the six corners, designated by reference characters A and B, of the ring-shaped disk 31 as shown in FIG. 3. By means of the outer corners A the disk 31 bears in the groove 42 of the bearing body 12, and by means of the inner corners B the disk 31 bears in the groove 41 of the ball-type rotor 19, so that there is desirably prevented any unintentional rotation of the rotor 19.

While there are shown and described present preferred embodiments of the invention, it is to be distinctly understood that the invention is not limited thereto, but may be otherwise variously embodied and practiced within the scope of the following claims. Accordingly,

We claim:

1. A safety apparatus for a spinning projectile fuze for a projectile having a lengthwise axis, comprising:

a substantially ball-shaped rotor which can rotate out of a safety position into an armed position;

a closure body member;

a support member;

said rotor being rotatably mounted between said closure body member and said support member;

a first substantially ring-shaped groove provided in said closure body member;

said first ring-shaped groove being located in a plane which is disposed essentially perpendicular to the lengthwise axis of the projectile;

a second substantially ring-shaped groove provided in said ball-shaped rotor;

said second ring-shaped groove being located, in the safety position of the rotor, in a plane which is substantially perpendicular with respect to the lengthwise axis of the projectile;

a safety spring in the form of a substantially ring-shaped disk member which protrudes both into the first ring-shaped groove and into the second ring-shaped groove for securing the rotor in its safety position;

said safety spring being deformable by the firing acceleration and by the projectile spin for releasing the rotor for movement into its armed position;

the ring-shaped disk member being subdivided by cut-outs into segments located in succession; and the successive segments being alternately directed in a substantially wave-shaped configuration upwardly and downwardly.

2. The safety apparatus as defined in claim 1, wherein:

said cut-outs form support points at the ring-shaped disk member, by means of which the rotor is retained in its safety position.

3. The safety apparatus as defined in claim 1, wherein:

said ring-shaped disk member is a split disk member.

4. The safety apparatus as defined in claim 1, wherein:

said support means comprises a guide disk.

5. The safety apparatus as defined in claim 1, wherein:

said ring-shaped disk member possesses web members formed by said cut-outs; and said web members allowing a deformation of said ring-shaped disk member under the action of the firing acceleration and the projectile spin.

6. The safety apparatus as defined in claim 5, wherein:

said ring-shaped disk member contains two substantially outer cut-outs and three inner cut-outs; and said inner cut-outs forming said web members which are deformable by the projectile spin.

* * * * *